US011147361B2

(12) United States Patent
Krivokapic et al.

(10) Patent No.: US 11,147,361 B2
(45) Date of Patent: Oct. 19, 2021

(54) MODULAR CARRIER SYSTEM

(71) Applicants: Nikola Krivokapic, Backa Planka (RS); Nemanja Drobac, Backa Planka (RS)

(72) Inventors: Nikola Krivokapic, Backa Planka (RS); Nemanja Drobac, Backa Planka (RS)

( * ) Notice: Subject to any disclaimer, the term of this patent is extended or adjusted under 35 U.S.C. 154(b) by 118 days.

(21) Appl. No.: 16/688,478

(22) Filed: Nov. 19, 2019

(65) Prior Publication Data

US 2021/0145156 A1 May 20, 2021

(51) Int. Cl.
*A45F 5/10* (2006.01)

(52) U.S. Cl.
CPC ..... *A45F 5/10* (2013.01); *A45F 2005/1013* (2013.01)

(58) Field of Classification Search
CPC ..... A45F 5/10; A45F 2005/1006; A45F 2005/1013
USPC ..... 294/138, 150, 153–155, 157, 165
See application file for complete search history.

(56) References Cited

U.S. PATENT DOCUMENTS 164,994 A * 6/1875 Harrell
347,415 A * 8/1886 Buchholz
412,295 A * 10/1889 Reynolds
424,806 A * 4/1890 Morris
504,307 A * 8/1893 Roberts
1,187,496 A * 6/1916 Bullock ..... A45F 5/10 294/155
1,212,190 A * 1/1917 Davis ..... A45F 5/10 294/155
2,978,154 A * 4/1961 Kailey ..... A45F 5/10 294/154
4,828,310 A 5/1989 Schmidt, Jr.
4,832,393 A * 5/1989 Pitchford ..... A44B 11/10 24/196
7,093,324 B2 8/2006 Udy
7,841,635 B2 11/2010 Fuchs
7,926,860 B2 4/2011 Hill
8,885,338 B1 * 11/2014 Simpson ..... G06F 1/1626 361/679.59
9,107,489 B1 * 8/2015 Wisniewski ..... A45F 5/10
2007/0006427 A1 1/2007 Callebresi
2009/0200347 A1 8/2009 Edralin
2014/0084614 A1 3/2014 Ganaza
2017/0055688 A1 * 3/2017 Lewis ..... A45F 5/10

* cited by examiner

*Primary Examiner* — Dean J Kramer
(74) *Attorney, Agent, or Firm* — Florkowski Law; William Florkowski

(57) ABSTRACT

Disclosed herein is a modular carrier system, which may facilitate the lifting, carrying, and movement of a wide variety of objects by one person or multiple people. In various embodiments, a modular carrier system may comprise a plurality of straps, a movable handle that may be positioned along the straps, and accessories for assisting in the moving and carrying of various types of objects.

20 Claims, 15 Drawing Sheets

2000

MODULAR CARRIER SYSTEM

FIELD OF DISCLOSURE

The present disclosure relates to devices and systems for carrying objects. More specifically, various embodiments of the present disclosure relate to a modular carrier system comprising strap and handle components that may be secured to a load for carrying.

BACKGROUND

Carrying objects is one of the oldest human endeavors. Over time, many systems have been devised to assist in lifting, carrying, and moving objects of various sizes, shapes, and weights by one or more people—from leather satchels to handled steamer trunks to backpacks to freight dollies to wheeled suitcases. However, where the current modalities succeed in diversity and specialization, they lack in universality and adaptability. A solution that is adaptable for one or multiple users to secure and carry a wide array of object types and form factors, and broadly configurable to a variety of loads, positions, and accessories, may therefore provide advantages over the traditional approaches.

In view of at least the above shortcomings, a need exists for a modular carrier system.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Examples described herein include modular carrier systems. Embodiments of a modular carrier system disclosed herein may comprise one or more handles and a plurality of straps. A handle may comprise a plurality of strap tunnels, and may be configured so as to permit a handle to traverse straps by sliding the straps through the strap tunnels, and fix in place with respect to the straps via a locking mechanism.

In some embodiments, straps may be secured to a load (e.g. a box, a stack of boxes, a mattress, a bundle of pipes, a log, a statue, etc.) by encircling the load or a portion or section thereof. Some embodiments may permit multiple handles to be attached to a single set of straps, or multiple handle-and-straps sets to be utilized with a load.

Various embodiments may comprise protective features to cushion or guard corners or edges of a load, a stabilizing system that may utilize perpendicular or transverse straps, and accessories of a wide variety, from netting to bases and dollies to measuring apparatus to magnets to clamps. One objective of the disclosed modular carrier system may be to provide a system whereby a user may attach one or more handles to a variety of objects and form factors, such as boxes, office equipment, home goods such as chairs and mattresses, odd-shaped objects such as sculptures or bundles of items, sporting equipment, construction and outdoor materials, and so forth.

Another objective of the disclosed modular carrier system may be to provide a way to secure a handle to a load for more convenient carrying.

Yet another objective of the disclosed modular carrier system may be to provide a handle of adjustable location with respect to straps secured to a load.

Still another objective of the disclosed modular carrier system may be to provide a carrying system that is broadly configurable, adjustable, and adaptable.

Again another objective of the disclosed modular carrier system may be to provide a carrying system configurable with a plurality of accessories.

Further, an objective of the disclosed modular carrier system may be to provide a carrying system having a means to stabilize loads via perpendicular or transverse strap configurations.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings and their brief descriptions below may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1A:
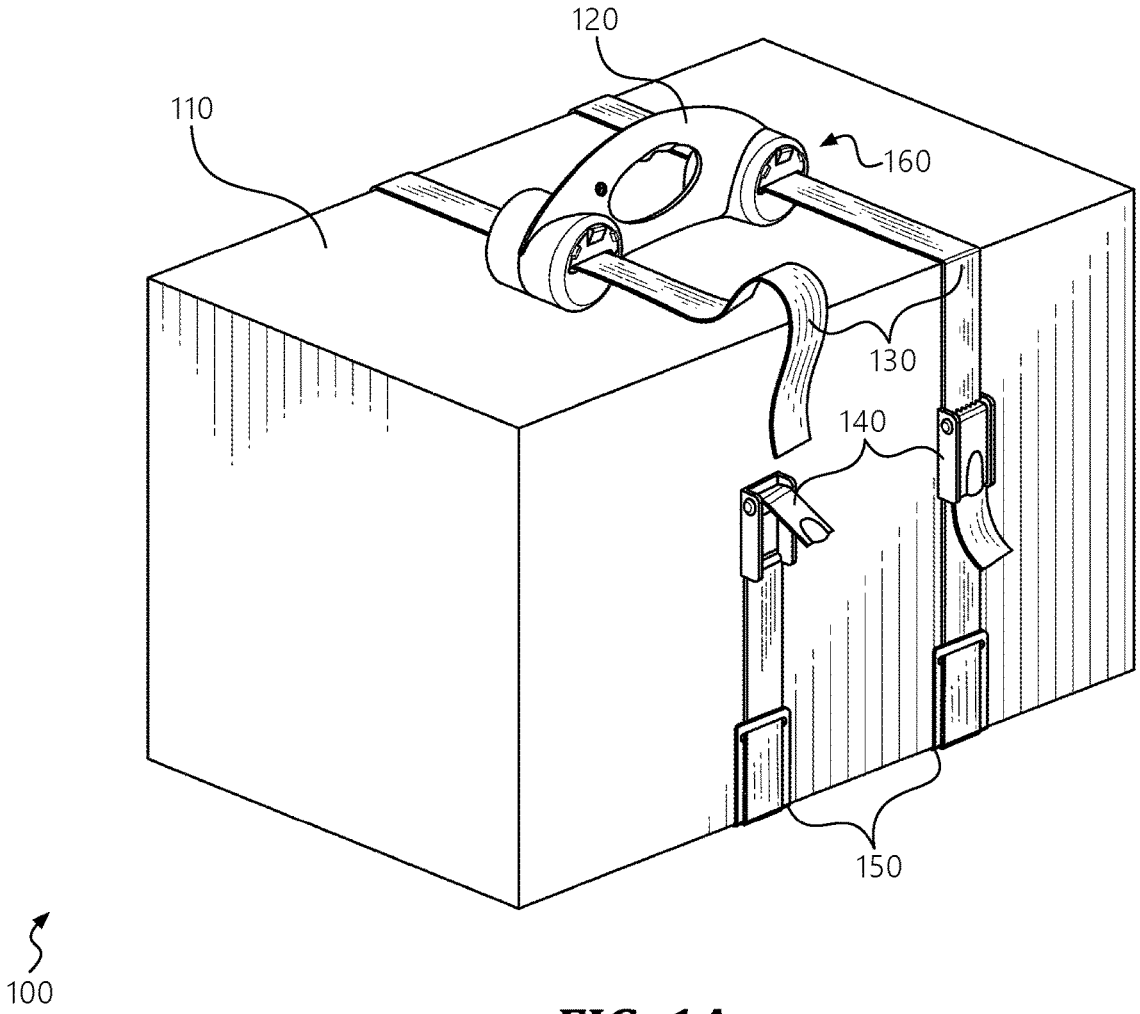
FIG. 1A illustrates a perspective view of an example modular carrier system in accordance with various embodiments of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of stages of various processes or methods that are described herein are illustrative and not restrictive. Accordingly, it should be understood that, although stages of various processes or methods may be shown and described as being in a sequence or temporal order, the stages of any such processes or methods are not limited to being carried out in any particular sequence or order, absent an indication otherwise. Indeed, the stages in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "stage for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of, embodiments of the present disclosure are not limited to use only in this context.

I. OVERVIEW

Figure 1B:
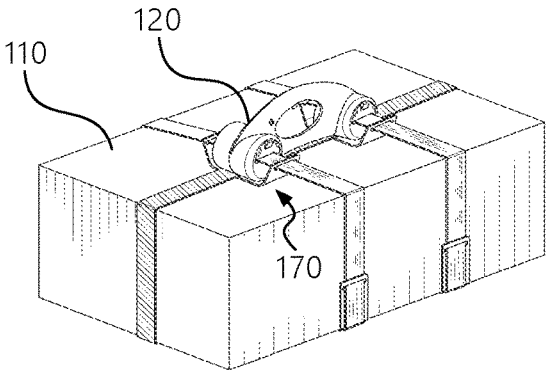
FIG. 1B illustrates a perspective view of an example modular carrier system comprising a stabilizing system in accordance with various embodiments of the present disclosure.
Figure 1C:
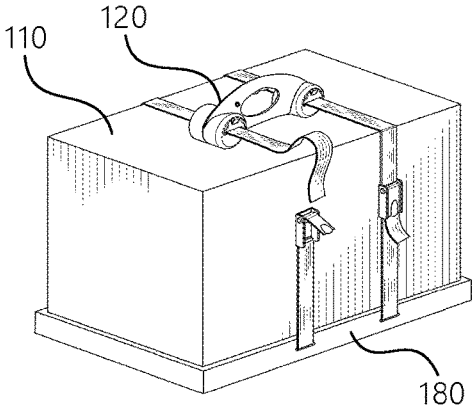
FIG. 1C illustrates a perspective view of an example modular carrier system comprising a base accessory in accordance with various embodiments of the present disclosure.

Consistent with embodiments of the present disclosure, a modular carrier system (or simply "system") 100 is provided. Various embodiments of system 100 are described herein. Components of system 100 as presented in the following disclosure may be integrated, used independently, in conjunction with, used separately, or in connection with other embodiments they are not shown or described as functioning with. Any aspects of one embodiment may or may not be used interchangeably with other elements and aspects of a modular carrier system 100 as presented in the present disclosure.

a. FIGS. 1A-C

Referring now to FIGS. 1A-C, there are shown example modular carrier systems 100 consistent with various embodiments of the present disclosure. System 100 may comprise a load 110 to be moved or carried, and a handle 120 which may be utilized to accomplish the same.

In various embodiments, each of a plurality of straps 130 may encircle some portion of load 110. A strap 130 may comprise or be attached or connected to a coupling mechanism (or "coupler") 140, such as a cam buckle or side-release buckle, via which strap 130 may be secured to load 110. Strap 130 may also comprise or be attached or connected to a protective feature (or "guard") 150, which may assist in protecting easily damaged aspects of load 110, and conversely may assist in protecting walls, floors, and other surroundings from sharp, angular, or abrasive features of load 110.

In various embodiments, handle 120 may slide along, and thus be positioned with respect to, straps 130 (and thus also load 110). Handle 120 may be fixed in place with respect to straps 130 via a locking mechanism (or "strap lock") 160. Thus, in an example, when a user wishes to pick up load 110, the user might position handle 120 in the preferred location along straps 130, engage strap locks 160 to secure the handle 120 in place, and then lift the load 110.

In some embodiments, system 100 may comprise a stabilizing system 170, which may comprise a transverse strap 130 and hardware elements to secure the entire ensemble of straps 130 and the handle 120. A stabilizing system 170 may provide benefits in how securely the load 110 (especially an irregularly shaped object or group) is ensconced in the modular carrier system 100, as well as structural integrity of the load 110 itself.

Figure 2:
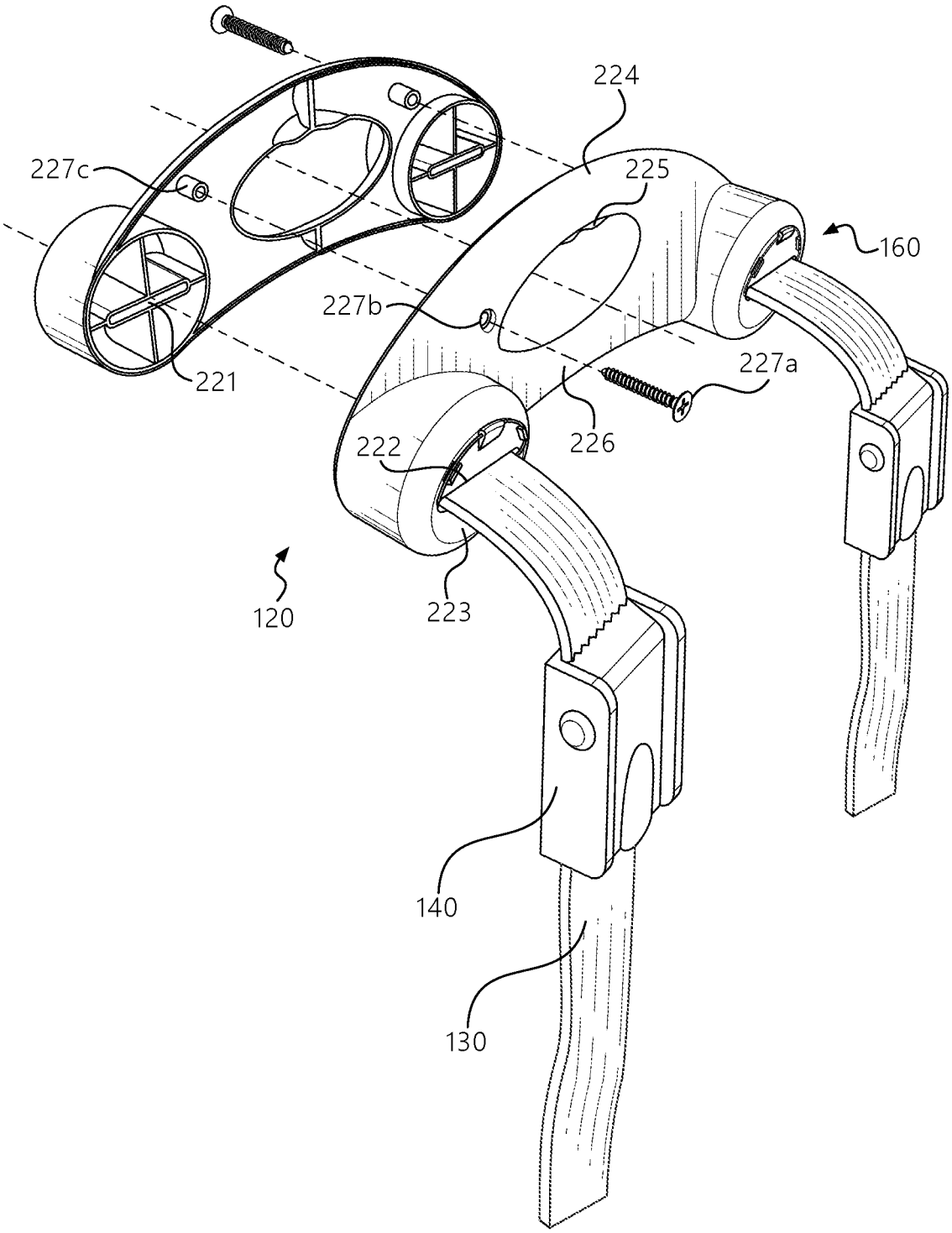
FIG. 2 illustrates an exploded view of a handle of an example modular carrier system in accordance with various embodiments of the present disclosure.

In some embodiments, system 100 may comprise one or more accessories 180, such as bases (which may provide a flat, level, durable surface for load 110), wheels and dolly-like elements, cargo netting, ties, clamps, carry troughs, measuring and weighing devices (which may provide benefits in certain shipping, cargo, and freight contexts), communication components (such as RFID), and so forth.

b. FIG. 2

Referring now to FIG. 2, there shown an exploded view of an example handle 120 of a modular carrier system 100 consistent with various embodiments of the present disclosure. Handle 120 may comprise a strap tunnel (or "tunnel") 221 which may be traversable by strap 130. Tunnel 221 may have a tunnel opening (or "opening") 222 on each of its terminal ends, whereupon tunnel 221 may open up at opening 222 on tunnel face (or "face") 223. A tunnel face 223 may be disposed at the exterior of either terminal end of tunnel 221. In some embodiments, a strap lock 160 may be disposed on one or more tunnel faces 223, which may permit a user to fix handle 120 in place by clamping down on strap 130 at strap lock 160.

Handle 120 may comprise a grip 224, which itself may comprise fingerhold features 225 that may improve the user's ability to grip and hold on to handle 120. Handle 120 may also comprise a bridge 226, which may form the bottom surface of handle 120 and may connect strap tunnel 221 structures together.

In some embodiments, handle 120 may be constructed from two or more pieces, and the assembly and integration thereof may utilize a wide variety of techniques. As depicted in FIG. 2, a fastening mechanism comprising screws or bolts 227*a*, through holes 227*b*, and threaded post holes 227*c* may secure two halves of handle 120 together.

c. FIGS. 3A-B, 4A-B

Referring now to FIGS. 3A-B, 4A-B, there is shown a front and side elevation view of an example modular carrier system 100, as well as side elevation views of an example locking mechanism 160, consistent with various embodiments of the present disclosure. In embodiments comprising guards 150, some such guards 150 may comprise protective strips (i.e. leather, padded, textured polymer) through which straps 130 may slide, via guard tunnels 351 on guard 150.

Figures 3A, 3B:
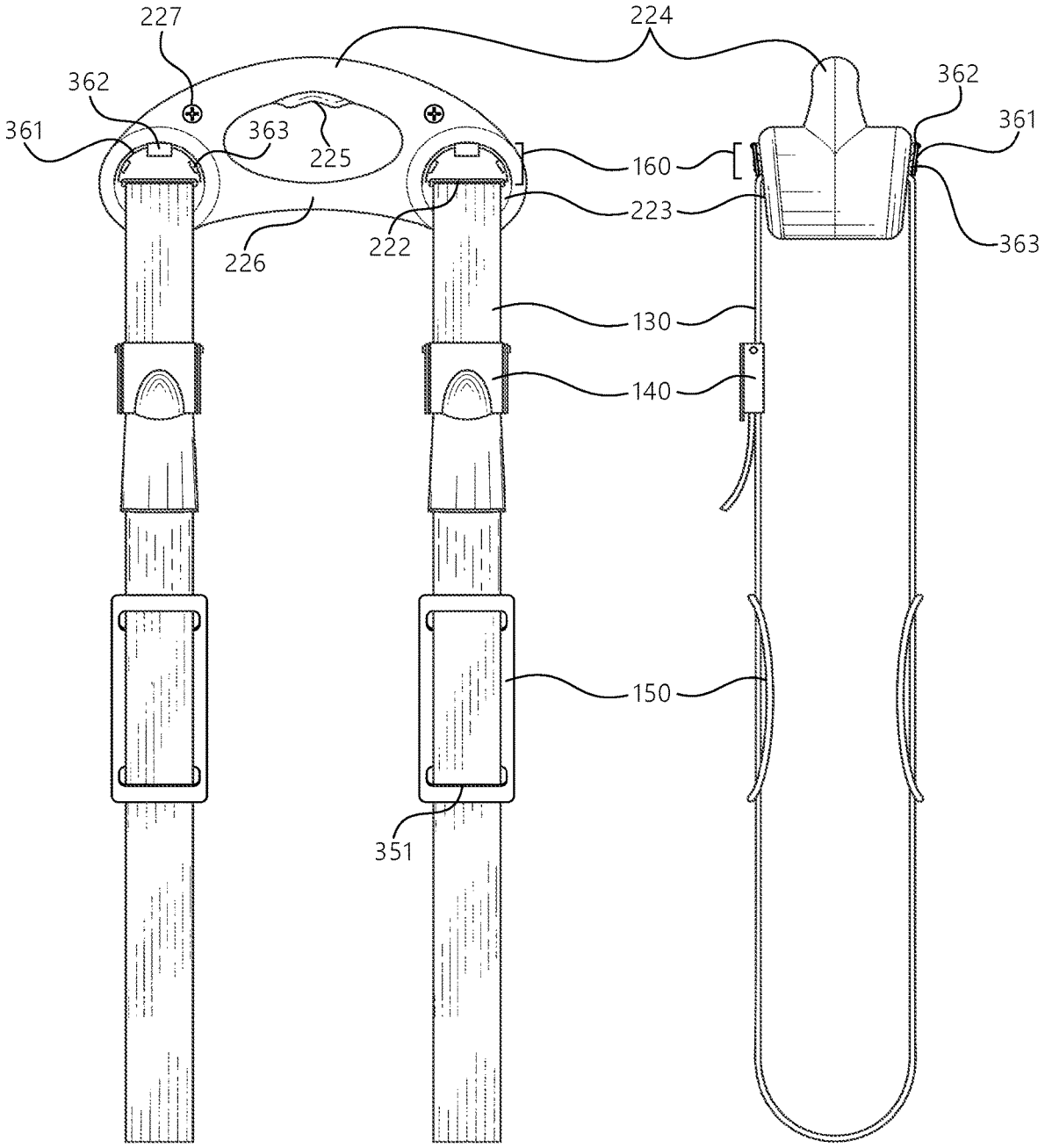
FIG. 3A illustrates a front elevation view of an example module carrier system in accordance with various embodiments of the present disclosure.
FIG. 3B illustrates a side elevation view of an example module carrier system in accordance with various embodiments of the present disclosure.
Figure 4A:
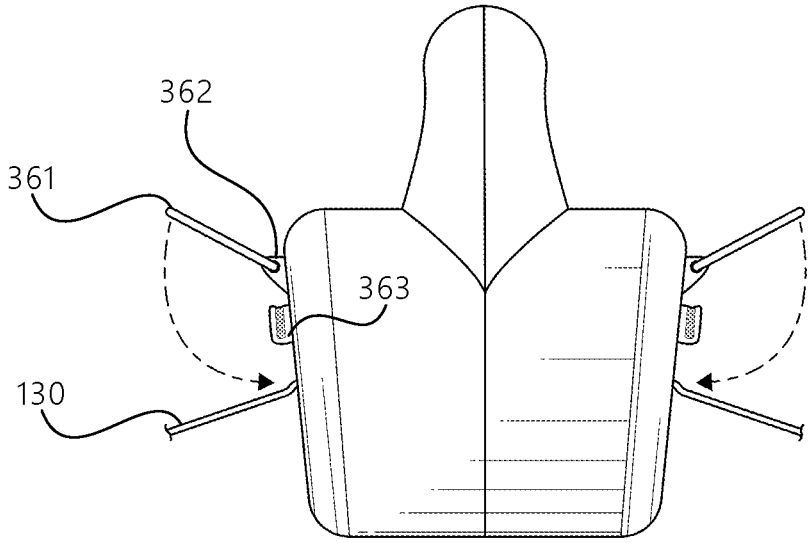
FIG. 4A illustrates a side elevation view of a handle having an example locking mechanism in an open configuration in accordance with various embodiments of the present disclosure.
Figure 4B:
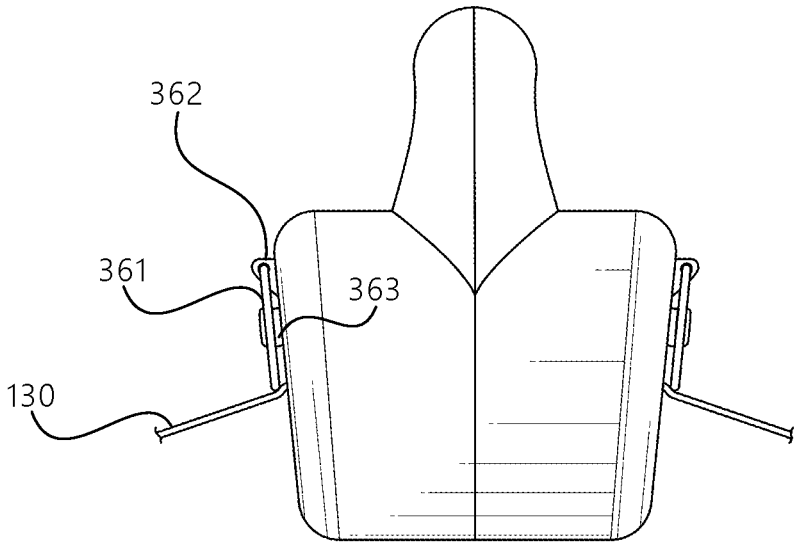
FIG. 4B illustrates a side elevation view of a handle having an example locking mechanism in a locked configuration in accordance with various embodiments of the present disclosure.
Figure 5A:
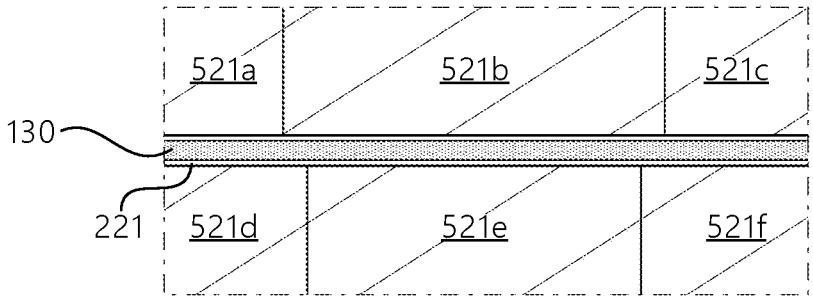
FIG. 5A illustrates a cross-sectional view of an example locking mechanism in an open configuration in accordance with various embodiments of the present disclosure.
Figure 5B:
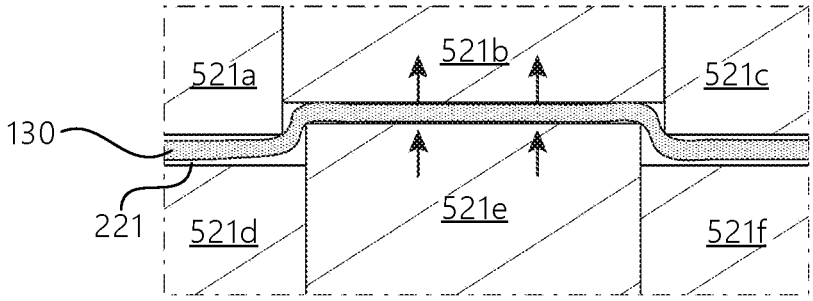
FIG. 5B illustrates a cross-sectional view of an example locking mechanism in a closed configuration in accordance with various embodiments of the present disclosure.

In embodiments comprising a strap lock 160, such may have a D-ring configuration, similar to as depicted in FIGS. 3A-B, 4A-B. In such an embodiment, strap lock 160 may comprise a ring 361, a hinge 362 by which ring 361 may pivot, and a clip 363 into which ring 361 may seat or click into place when engaged in a locked configuration. In such an embodiment, engaging ring 361 into a locked configuration by pivoting it toward strap 130 (similar to as depicted in FIG. 4A) and seating it in clip 363 (similar to as depicted in FIG. 4B) may apply a clamping force to strap 130 and prevent it from sliding through tunnel 221.

d. FIGS. 5A-B

Referring now to FIGS. 5A-B, there is shown an example locking mechanism 160 of a modular carrier system 100 consistent with various embodiments of the present disclosure. In embodiments comprising a strap lock 160, such may have an internal clamping configuration, similar to as depicted in FIGS. 5A-B.

One example of how such an embodiment may operate is a mechanism comprising elements of tunnel 221 that may move with respect to each other (i.e. by spring, by moving along threaded members, etc.). Such elements may, in an open configuration, operate normally as a tunnel 221 for strap 130 (similar to as depicted in FIG. 5A), whereas when moved in to a locked configuration—for example, elements 521*b* and 521*e* moving up with respect to the surrounding elements 521*a*, 521*c*, 521*d*, and 521*f*—they may force strap 130 into a kinked path, which may limit or prevent traversal of strap 130 through tunnel 221.

e. FIGS. 6-9

Referring now to FIGS. 6-9, there are shown various example configurations of modular carrier systems 100 consistent with various embodiments of the present disclosure. System 100 may be consistent with embodiments comprising a wide array of strap 130 and handle 120 configurations and combinations.

Figure 6:
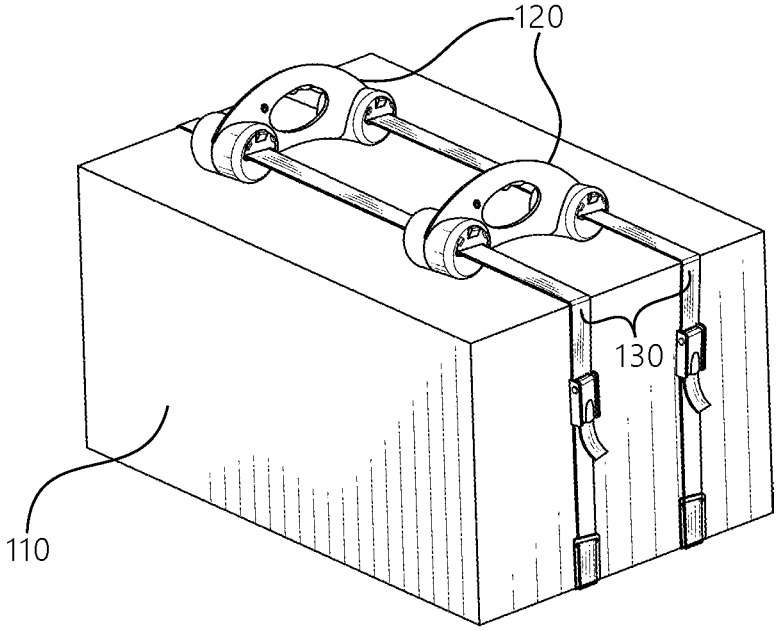
FIG. 6 illustrates a perspective view of an example modular carrier system comprising two straps and two handles configured on top of a load in accordance with various embodiments of the present disclosure.

In an example embodiment, similar to as depicted in FIG. 6, a set of two straps 130 may be secured to load 110 with two (or more) handles 120 attached to the straps 130. The handles 120 may be positioned, and may be fixable in place, in a "both on one side" configuration.

Figure 7:
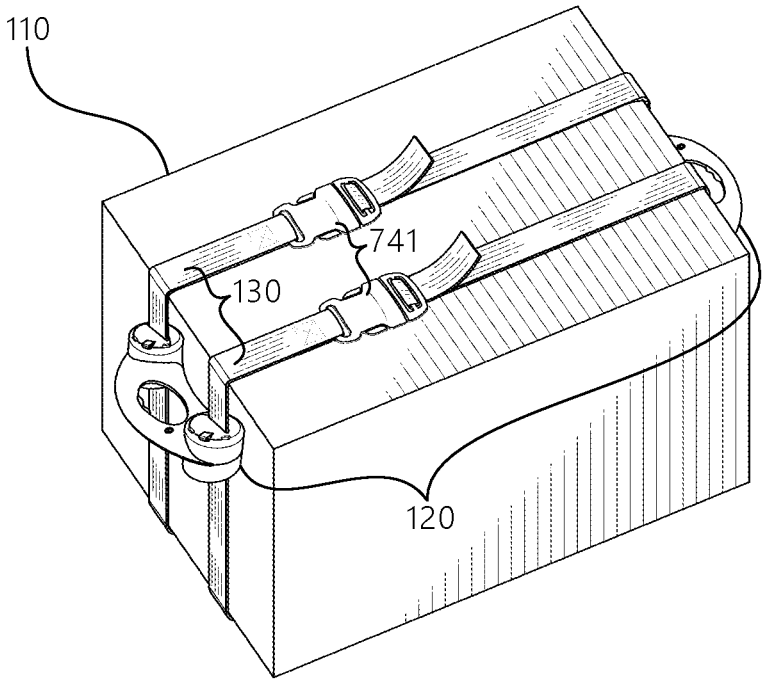
FIG. 7 illustrates a perspective view of an example modular carrier system comprising two straps and two handles configured on opposite ends of a load in accordance with various embodiments of the present disclosure.

In another example embodiment, similar to as depicted in FIG. 7, a set of two straps 130 may be secured to load 110 with two (or more) handles 120 attached to the straps 130. The handles 120 may be positioned, and may be fixable in place, in a "one on each side" configuration. Such a configuration may provide one user the ability to more comfortably carry an object they would ordinarily have to lift from below, or two users the ability to work together to each carry one end of a heavy object. Further, it should be noted that side release buckles 741 are one amongst a wide variety of couplers 140 that may be employed.

Figure 8:
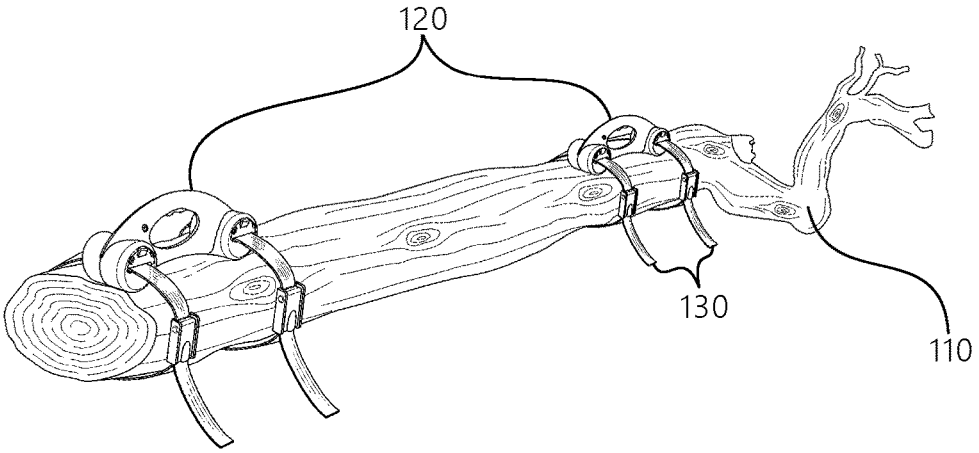
FIG. 8 illustrates a perspective view of an example modular carrier system comprising four straps and two handles in accordance with various embodiments of the present disclosure.

In yet another example embodiment, similar to as depicted in FIG. 8, two (or more) sets of two straps 130 may be secured to a load 110 with a handle 120 attached to each of the sets of straps 130. Such a configuration may provide two users the ability to work together to move an object that is long, awkwardly shaped, and/or heavy.

Figure 9:
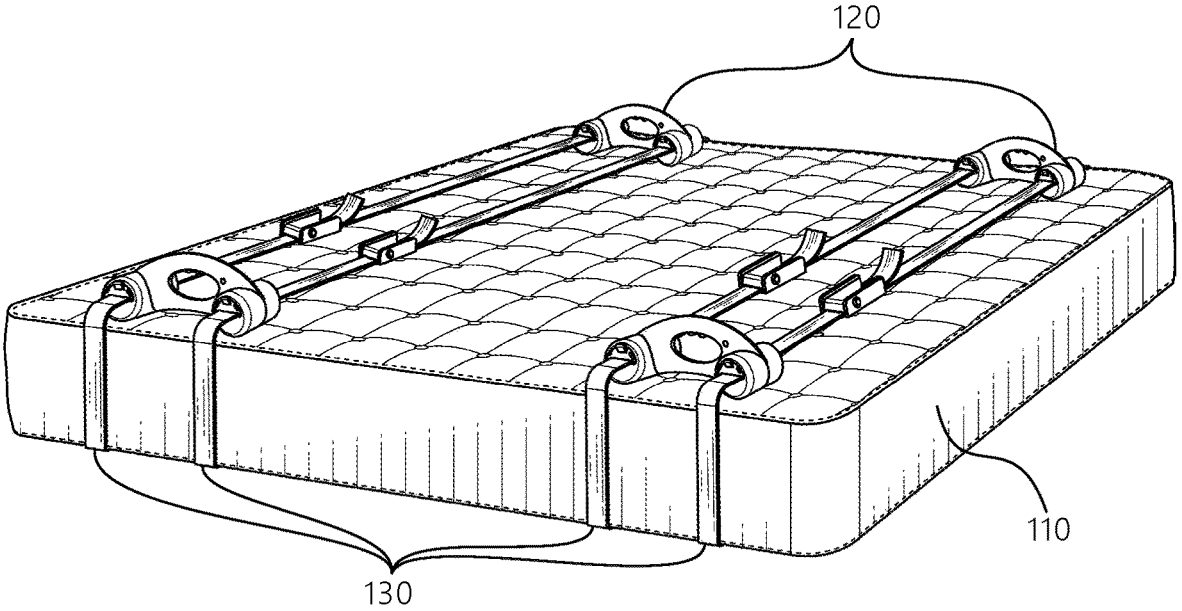
FIG. 9 illustrates a perspective view of an example modular carrier system comprising four straps and four handles in accordance with various embodiments of the present disclosure.
Figure 10:
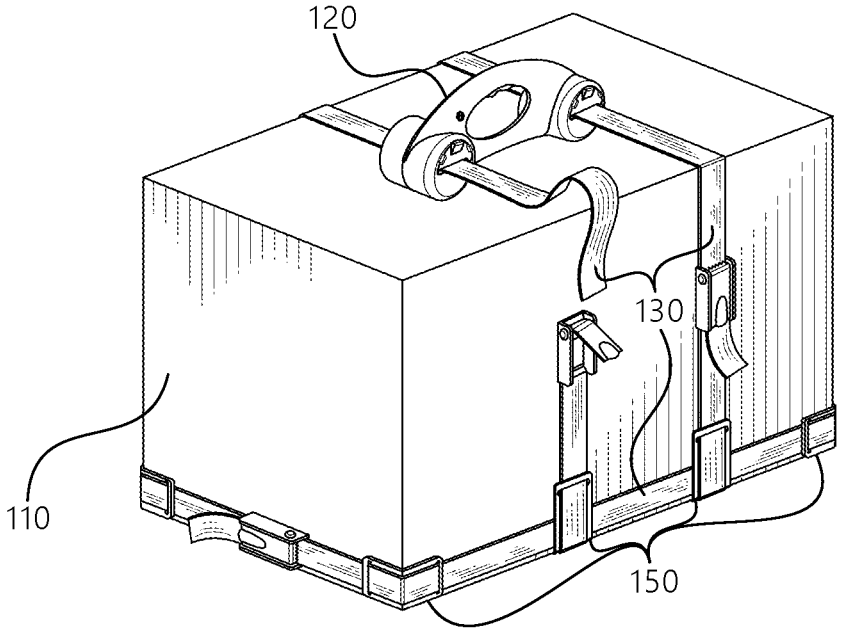
FIG. 10 illustrates a perspective view of an example modular carrier system comprising protective features in accordance with various embodiments of the present disclosure.

In still another example embodiment, similar to as depicted in FIG. 9, two (or more) sets of two straps 130 may be secured to a load 110 with two (or more) handles 120 attached to each of the sets of straps 130. Such a configuration may provide two users the ability to work together to move an object that is unwieldy, large in multiple dimensions, and/or heavy.

f. FIG. 10

Figure 11:
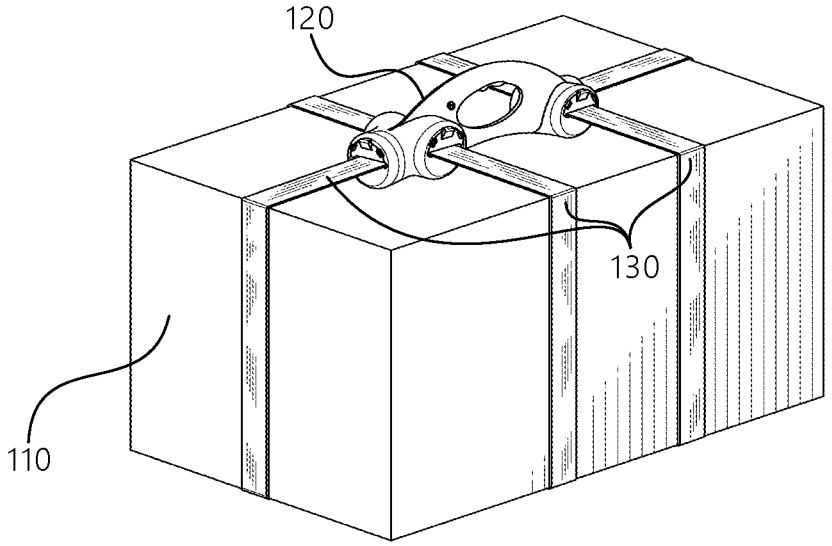
FIG. 11 illustrates a perspective view of an example modular carrier system comprising three straps and one handle in accordance with various embodiments of the present disclosure.

Referring now to FIG. 10, there is shown an example strap 130 and protective feature 150 configuration of a modular carrier system 100 consistent with various embodiments of the present disclosure. In an embodiment, an additional transverse strap 130 may provide benefits of stability (especially with loads 110 that tend to bulge or whose horizontal integrity is questionable, as with an aging and worn box), and additional placement for guards 150 (e.g. corner protectors) or accessories 180 (e.g. cover or netting anchor points at corners).

g. FIG. 11

Figure 12A:
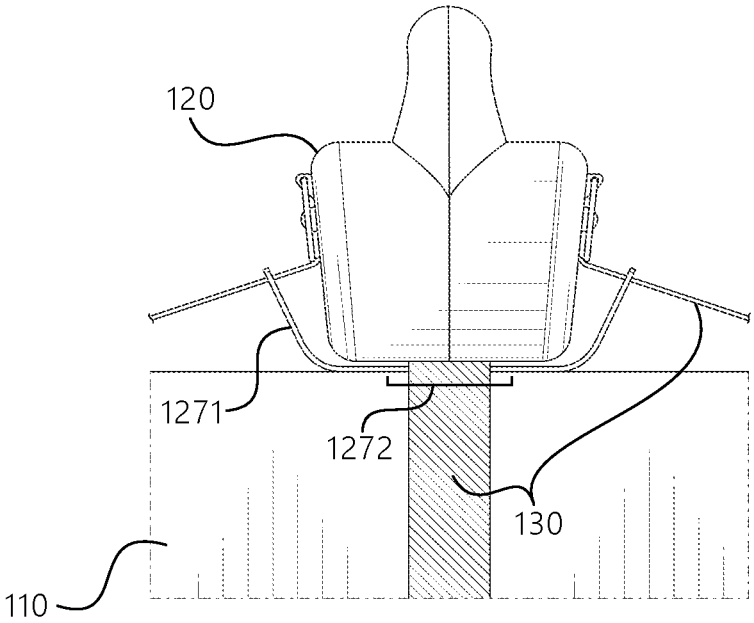
FIG. 12A illustrates a side elevation view of an example modular carrier system comprising a stabilizing system in accordance with various embodiments of the present disclosure.
Figure 12B:
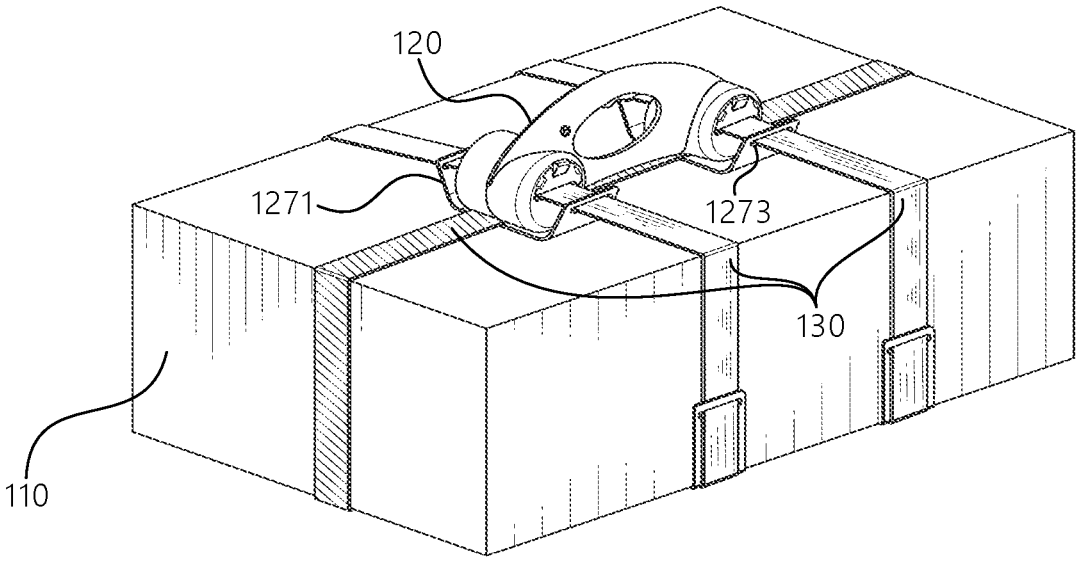
FIG. 12B illustrates a perspective view of an example modular carrier system comprising a stabilizing system in accordance with various embodiments of the present disclosure.

Referring now to FIG. 11, there is shown an example modular carrier system 100 comprising a handle 120 configuration comprising more than two strap tunnels 221 consistent with various embodiments of the present disclosure. In an embodiment, handle 120 may comprise a third, transverse strap tunnel 221, which may provide benefits of carrying stability and load 110 integrity.

h. FIGS. 12A-B

Referring now to FIGS. 12A-B, there is shown a side elevation and perspective view of an example modular carrier system 100 comprising a stabilizing system 170 consistent with various embodiments of the present disclosure. A stabilizing system 170 may comprise a stabilizer 1271, which itself may comprise a stabilizer channels (or "channel") 1272, and stabilizer tunnels (or "tunnels") 1273.

In an embodiment consistent with the depiction in FIGS. 12A-B, stabilizer 1271 may comprise a broad, u-shaped trough which may be disposed underneath a strap tunnel 221 and flanking its tunnel faces 223. Strap 130, extending out from either of the strap tunnel's 221 openings 222, may pass through corresponding stabilizer tunnels 1273 in stabilizer 1271. This may have the effect of fixing stabilizer 1271 in place with respect to handle 120 (and, correspondingly, in place with respect to load 110, to which straps 130 may be secured). A transverse strap 130 may be threaded through stabilizer channel 1272, disposed underneath handle 120, and secured to load 110.

Figure 13:
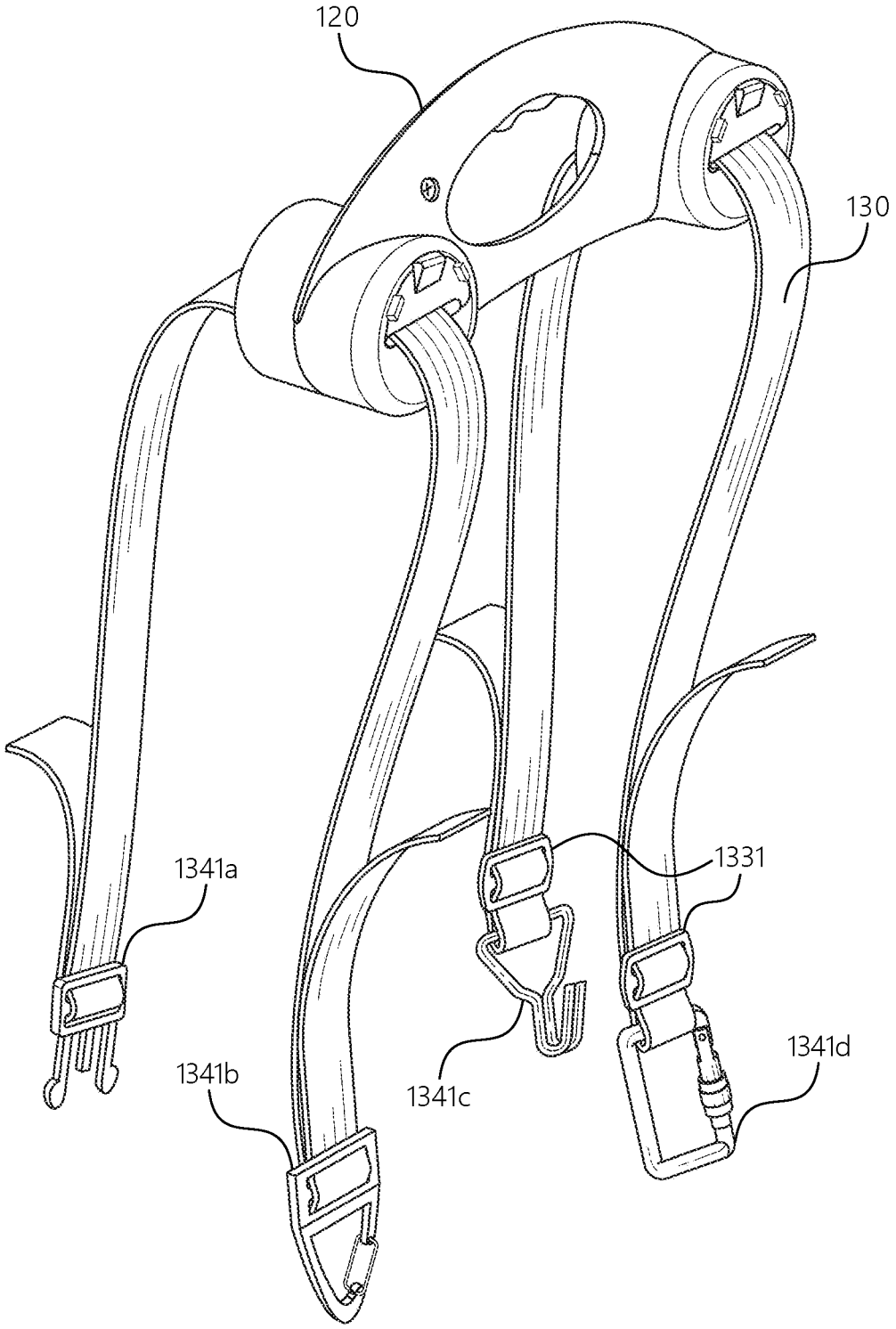
FIG. 13 illustrates a perspective view of an illustrative example of various coupling mechanisms in accordance with various embodiments of the present disclosure.

Such a configuration may provide benefits of carrying stability and load 110 integrity. For example, a stabilizing system 170 may permit the securing of a collection of objects such as a stack of books or boxes.

i. FIG. 13

Figure 14:
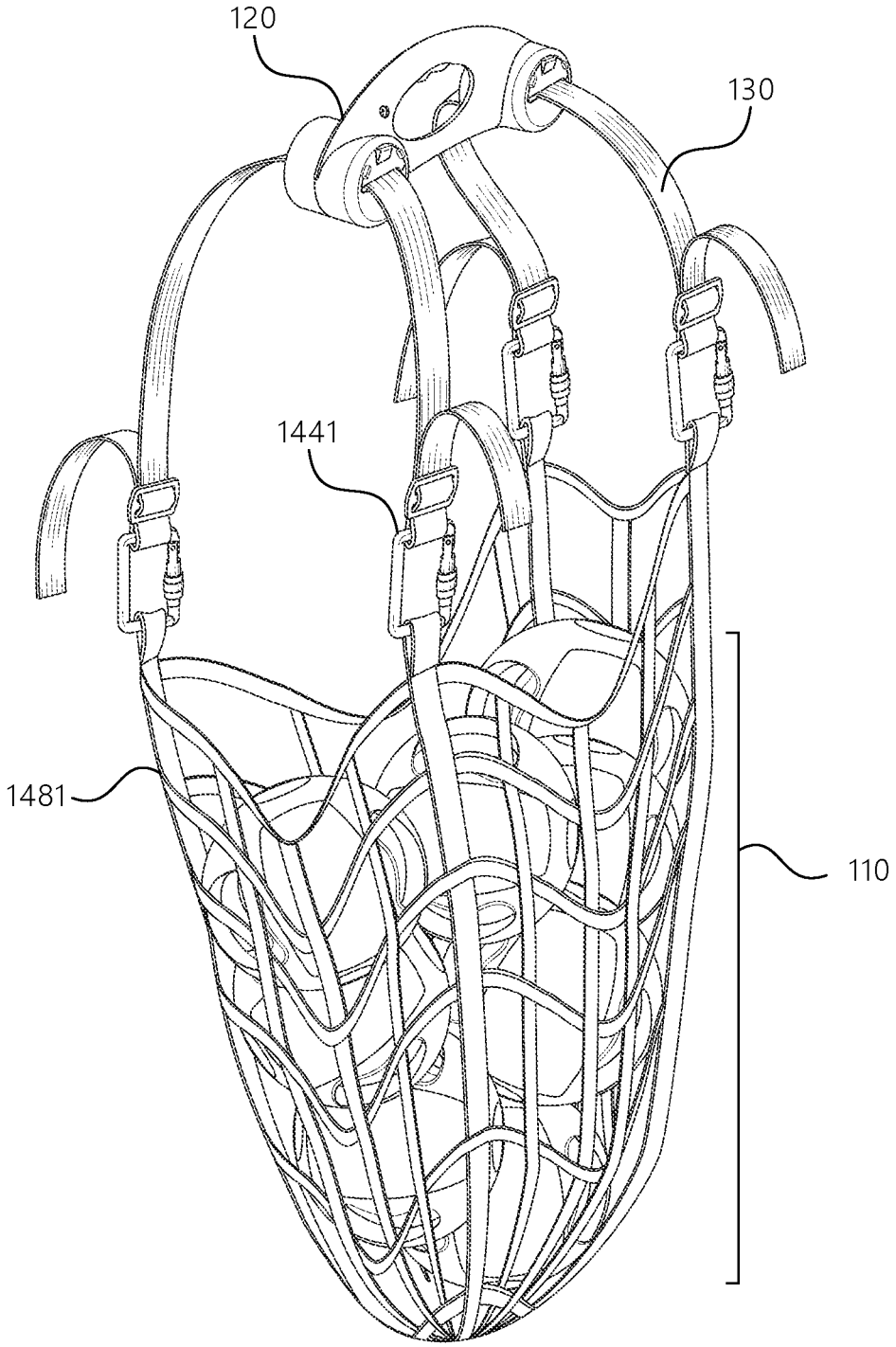
FIG. 14 illustrates a perspective view of an example modular carrier system comprising a netting accessory in accordance with various embodiments of the present disclosure.
Figure 15:
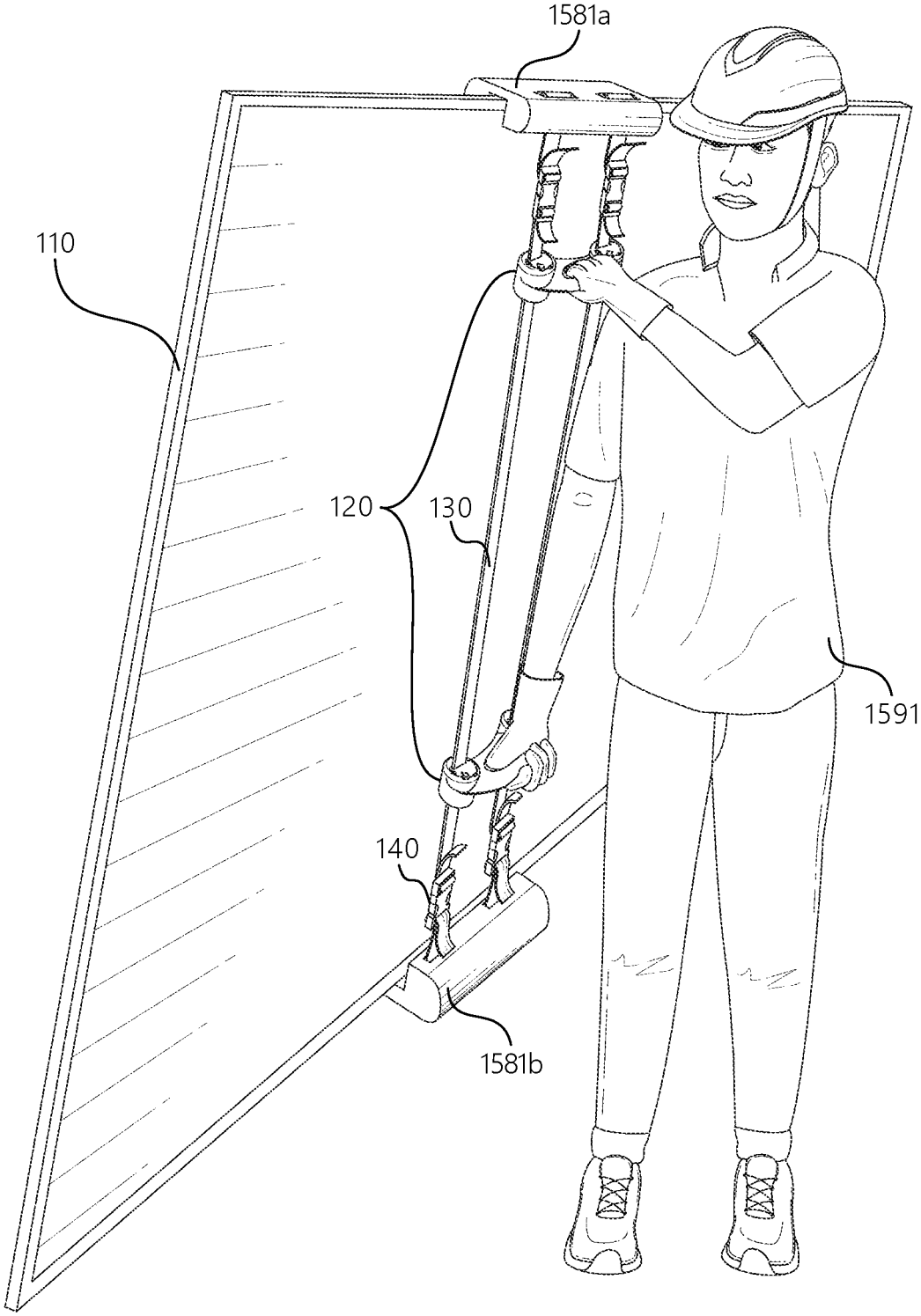
FIG. 15 illustrates a perspective view of an example modular carrier system comprising a trough accessory in accordance with various embodiments of the present disclosure.

Referring now to FIG. 13, there is shown an illustrative example of a modular carrier system 100 featuring various coupling mechanisms 140 consistent with various embodiments of the present disclosure. In various embodiments, system 100 may comprise one or more straps 130 that comprise, or are attached or connected to couplers 140 of wide variety. For example, consistent with the system 100 depicted in FIG. 13, a strap may interface with a coupler 140 such as a side-release buckle 1341*a*, a triangular carabiner 1341*b*, a hook 1341*c*, or a square locking carabiner 1341*d*. Various couplers 140 such as 1341*a* and 1341*b* may comprise their own integrated attachment systems (e.g. sewn in, built-in ladder lock), while others such as 1341*c* and 1341*d* may require additional components to attach, such as a standalone ladder lock 1331 or a quick-attach buckle.

j. FIGS. 14-15

Referring now to FIGS. 14-15, there are shown example configurations of modular carrier systems 100 comprising accessories 180 that may be assistive in carrying certain types of loads 110, consistent with various embodiments of the present disclosure.

In an example embodiment, system 100 may comprise carabiner couplers 1441 attaching to corner loops on a cargo netting accessory 1481, which may be a helpful configuration for carrying a load 110 comprising irregular, difficult to stack objects (such as medicine balls, as depicted, or footballs). Handle 120 may thus be used to haul an unwieldy load 110 by utilizing system 100 in a bag-like or satchel-like configuration.

In another example embodiment, system 100 may comprise side-release buckle couplers 140 attaching to carry trough accessories 1581*a*, 1581*b*, which may be secured to a large-dimensioned, heavy load 110 such as plywood or sheetrock. Thus, for example, a user 1591 in a construction setting might utilize a pair of handles 120 fixed (e.g. by one or more locking mechanisms 160) along straps 130 to lift and transport a load 110 that might ordinarily call for multiple carriers, a special purpose tool, or a mechanized system.

k. FIGS. 16-19

Referring now to FIGS. 16-19, there are shown various example configurations of modular carrier systems 100 comprising base accessories 1681, 1781, 1881, 1981 consistent with various embodiments of the present disclosure.

Figure 16:
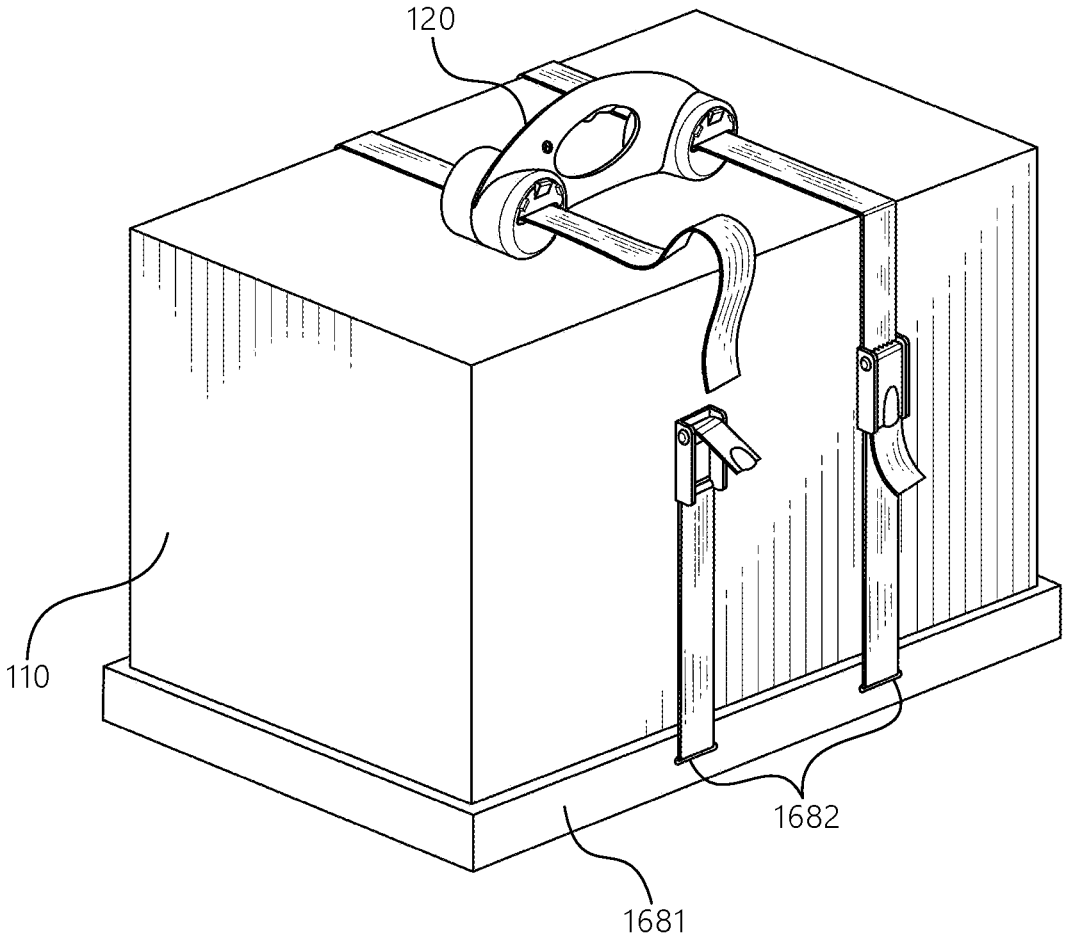
FIG. 16 illustrates a perspective view of an example modular carrier system comprising a base accessory in accordance with various embodiments of the present disclosure.

In an example embodiment, similar to as depicted in FIG. 16, load 110 may be secured to base accessory (or "base") 1681, which may provide a flat, level, durable surface upon which to dispose load 110 and which may facilitate easier transport, loading, set-down, and interaction with automated systems (e.g. conveyor belts, fork lifts). Base 1681 may comprise slots to facilitate movement by forklift. Base 1681 may comprise base tunnels 1682 that may permit straps 130 to slide through and secure the entire assemblage.

Figure 17:
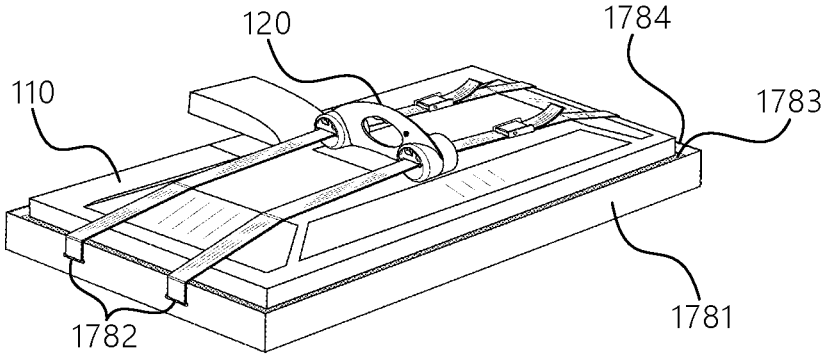
FIG. 17 illustrates a perspective view of an example modular carrier system comprising a troughed base accessory in accordance with various embodiments of the present disclosure.

In another example embodiment, similar to as depicted in FIG. 17, load 110 may be secured to troughed base accessory 1781, which may provide many benefits as described for base 1681, as well as an interior trough that may aid in securing flat, wide loads 110 such as flat screen televisions or paintings. A troughed base accessory 1781 may comprise a trough surface 1783 that may provide a soft or scratch-preventing (e.g. microfiber) surface. A troughed base accessory 1781 may also comprise a trough wall 1784 that may prevent the load 110 from sliding off of troughed base accessory 1781, secured as it may be by straps 130 threading through base tunnels 1782.

Figure 18:
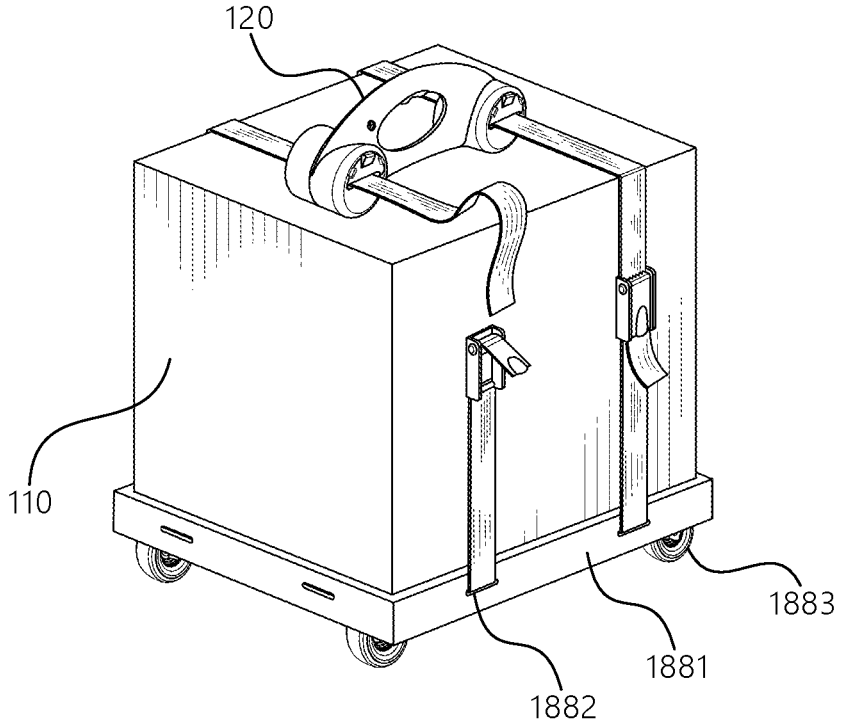
FIG. 18 illustrates a perspective view of an example modular carrier system comprising a wheeled base accessory in accordance with various embodiments of the present disclosure.

In yet another example embodiment, similar to as depicted in FIG. 18, load 110 may be secured to wheeled base accessory 1881, which may provide many benefits as described for base 1681, as well as the ease of transporting load 110 on wheels 1883, via a dolly-like conveyance that may also be secured via straps 130 threading through base tunnels 1882.

Figure 19:
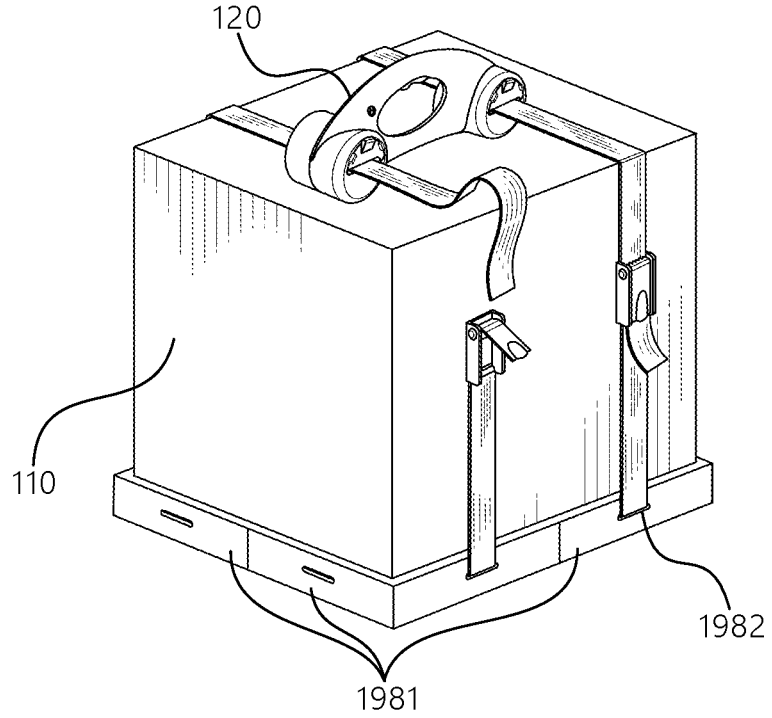
FIG. 19 illustrates a perspective view of an example modular carrier system comprising a modular base accessory in accordance with various embodiments of the present disclosure.

In still another example embodiment, similar to as depicted in FIG. 19, load 110 may be secured to modular base accessory 1981, which may provide many benefits as described for base 1681, as well as the flexibility to connect together base subunits to accommodate loads 110 with larger, smaller, or irregular footprints. As with many other base configurations and form factors, load 110 may be secured to modular base accessory 1981 via straps 130 threading through base tunnels 1982.

II. COMPONENTS

Some or all of the following components may be present in a modular carrier system 100. The below description is in no way intended to limit the components that may be present in addition or in alternative to the listed components, nor to require that any particular component be included in a form described below or at all.

a. Load 110

System 100 may be utilized to lift, carry, drag, move, etc. load 110. Load 110 may comprise a unitary object or a collection of objects. Load 110 may be "regular" like a box or mattress, or irregular like a vase or statue. Embodiments of system 100 may have various limitations in the weight of load 110 that can be interacted with, depending on factors such as handle 120, strap 130, and coupler 140 composition. In some embodiments, loads 110 of 50 kg, 100 kg, or more may be carriable via system 100.

b. Handle 120

System 100 may comprise a handle 120. Handle 120, and parts thereof, may comprise various materials including metal, wood, polymers such as polycarbonate, composites, and so forth. Handle 120 may incorporate various features that may make grip 224 more "grippable," or easier to hold on to without slipping, such as fingerhold features 225 or grip features (i.e. a material, pattern, or texture on the surface of grip 224 that may improve friction or slip characteristics). In some embodiments, the body of handle 120 may be fabricated as a single part (i.e. by additive manufacturing).

Grip 224 may be closed, i.e. forming a "hole" of some geometry in handle 120 (similar to as depicted in FIG. 2), or grip 224 may be open, having a protrusion that may be gripped.

Tunnel face 223 may, in some embodiments, be angled inward from top to bottom, which may improve strap 130 seating, facilitate smoother or easier carrying, and/or mitigate internal stresses in handle 120.

Handle 120 may, but need not, have exactly two strap tunnels 221. For example, similar to as depicted in FIG. 11, handle 120 may comprise a third, transverse strap tunnel 221. For another example, handle 120 may comprise three (or more) strap tunnels 221 in parallel, angled, "crisscrossing," and other configurations of strap tunnels 221.

c. Strap 130

System 100 may comprise a strap 130. A strap 130 may comprise webbing material, nylon, jute, cotton, elastic, metallic cord, and various other materials. A strap 130 may, but need not, be thin and flat in shape. For example, in some embodiments, system 100 may comprise one or more straps 130 having a rope-like, chain-like, coiled, or other form factors. Strap 130 may comprise holes (e.g. grommeted holes) for the attachment of hooks and other accessories 180.

d. Coupling Mechanism 140

System 100 may comprise a coupling mechanism 140. Couplers 140 may come in a variety of materials, for example durable polymers and metals. Couplers 140 may also come in variety of form factors and methods of action, including, but not limited to, side release clip buckles, top release clip buckles, multi-way clip buckles, ratchet straps, ratchet and toothed-track buckles, magnetic buckles, clamp buckles, cam lock buckles, multi-ring buckles, ladder lock buckles, tension lock buckles, quick-attach buckles, carabiners, threaded members, hooks, hook and loop systems, and spring release mechanisms.

e. Protective Feature 150

System 100 may comprise protective features 150. A guard 150 may comprise various materials depending on use case. Guard 150 may be required to be, for example, durable, cushioning, non-marking (e.g. for floors and walls), semi-rigid (e.g. for corner protection), and so forth, covering a range of requirements. Protective features 150 may slot directly with straps 130 (i.e. through guard channel 351), as depicted in FIGS. 3A-B, 10. Protective features 150 may also interface with system 100 via couplers 140 such as hooks or carabiners, or accessories 180 such as the floor of a base accessory.

f. Locking Mechanism 160

System 100 may comprise a locking mechanism 160. Strap lock 160 may comprise various clamping modalities that may limit or prevent movement of straps 130 through strap tunnels 221 or at other points around load 110. Apart from D-ring and internal clamping strap locks 160, embodiments may feature various kinds of locking mechanisms 160, such as twist locking and pin locking (e.g. in embodiments featuring straps 130 comprising grommeted holes).

g. Stabilizing System 170

System 100 may comprise a stabilizing system 170. Stabilizer 1271 may comprise various materials, for example durable polymers and metals. Stabilizing system 170 may comprise a locking mechanism 160, in addition or alternative to locking mechanisms 160 based in handle 120. Stabilizer channel 1272 may comprise a groove, guide, or tunnel system to constrain the path of transverse strap 130.

h. Accessory 180

System 100 may comprise an accessory 180. Accessories 180 may fill a wide variety of roles, from assisting in carrying and protecting loads 110, to providing enhanced functionality such as rolling or gliding (or preventing the same), to providing connective or interfacing features, to providing informational and communicative functionality. Accessories 180 may share some overlapping functionality with couplers 140, guards 150, and other elements.

Accessories 180 may comprise, but are not limited to, guards, pads, cushions, mounts, hooks, rings, snaps, buckles, hook and loop systems, suction cups, magnets, elastic cords, bungees, chains, tie down and ratchet straps, netting elements, tarpaulins, threaded fasteners, cinches, clamps, cable ties, adhesives, toothed-edge components, trays, bases, plates, brackets, troughs, wheels, friction-reducing surfaces, friction-enhancing surfaces, measurement devices, retractors, screens, and communications components.

III. METHOD OF USE

Figure 20:
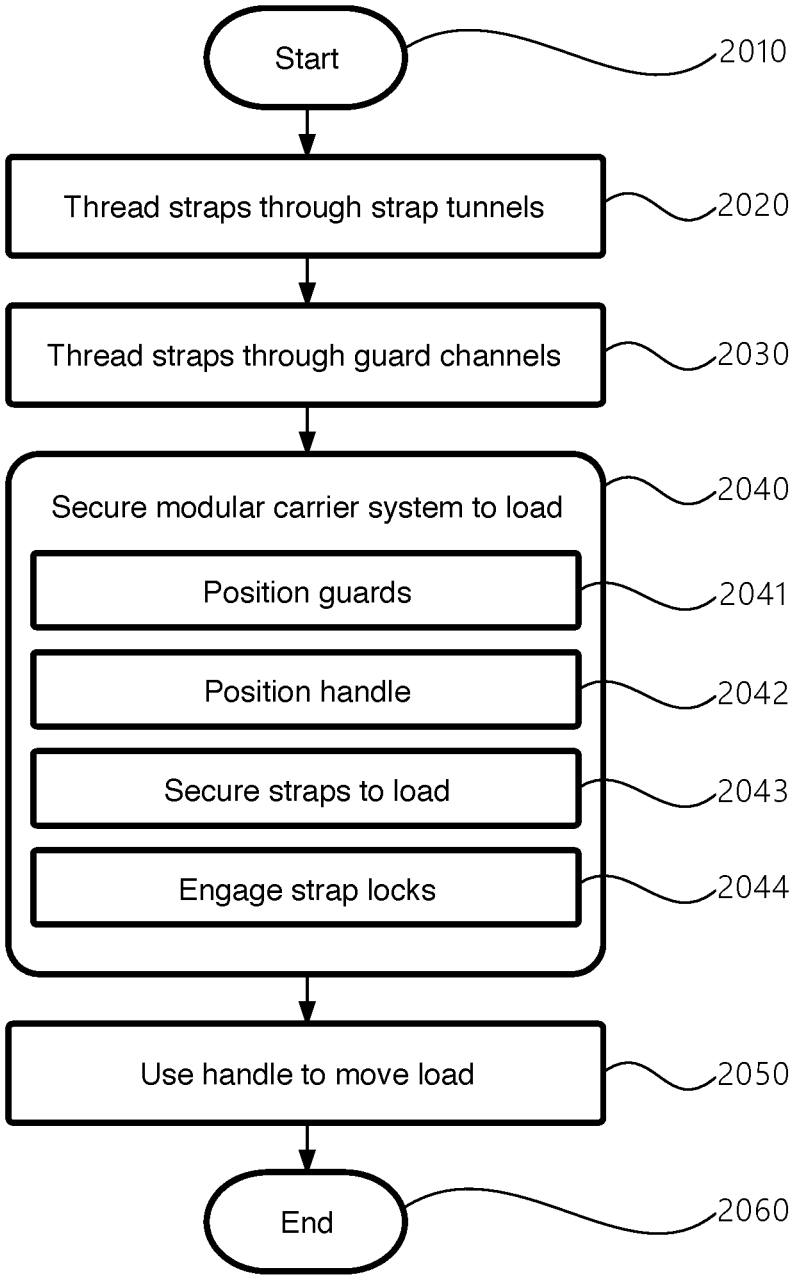
FIG. 20 illustrates a flow diagram depicting an example method of using a modular carrier system in accordance with various embodiments of the present disclosure.

Referring now to FIG. 20, there is shown an example method 2000 of utilizing modular carrier system 100. At stage 2010, method 2000 may begin.

At stage 2020, a user may thread straps 130 through strap tunnels 221, which may comprise feeding an end of strap 130 all the way through from one tunnel opening 222 of the strap tunnel 221 to the other. In some embodiments, a plurality of straps 130 may be threaded through strap tunnels 221. In various embodiments, strap 130 may comprise a flat webbing material, and strap tunnel 221 may comprise a narrow, oblong tunnel. In some embodiments featuring a locking mechanism 160 internal to handle 120 and to strap tunnel 221, wherein a locked state may be the default (e.g. due to spring tension), it may be necessary to engage a mechanism such as a lever in grip 224 to unlock the interior of strap tunnel 221 such that strap 130 may slide through.

At stage 2030, in embodiments comprising guards 150, and where such guards 150 comprise channels 351, the user may thread straps 130 through channels 351 of guards 150. In various embodiments where guards 150 comprise padding or cover material, this stage may be accomplished by various means, including, e.g., attaching quick-attach buckles to straps 130.

At stage 2040, the user may secure system 100 to load 110. This stage may comprise encircling load 110 with straps 130, which during this stage may be, or during prior stages have been, disposed in roughly appropriate locations with respect to load 110. It may be advantageous during stage 2040 to perform a pre-tightening of straps 130 prior to fully securing and/or finally positioning various aspects (e.g. handles 120, guards 150, stabilizing systems 170, accessories 180) of system 100 with respect to load 110. Stage 2040 may comprise various substages, which may be performed out of order, repeated, or in combination with other actions not depicted in FIG. 20.

At substage 2041, in embodiments comprising guards 150, the user may position guards 150 in apt locations, such as around corners, edges, or fragile aspects of load 110.

At substage 2042, the user may position handle 120 with respect to load 110 and straps 130. In an example, a user may position one or more handles 120 at or about the top of load 110, similar to as depicted in FIG. 6. In another example, a user may position one or more handles 120 at or about the sides of load 110, similar to as depicted in FIG. 7.

At substage 2043, the user may secure straps 130 to load 110. In some embodiments where couplers 140 may comprise cam buckles (similar to as depicted in FIG. 6), straps 130 may during this substage be, or during prior stages/substages have been, threaded through the buckle, and may require further tightening to cinch straps 130 to load 110. In embodiments where couplers 140 may comprise side- or top-release buckles (similar to as depicted in FIG. 7), such couplers 140 may during this stage be, or during prior stages have been, clicked together to secure ends of straps 130, and may require further tightening to cinch straps 130 to load 110. In embodiments comprising a base accessory 1681, 1781, 1881, 1981 of some type, securing straps 130 to load 110 may further comprise threading straps 130 through tunnels 1682, 1782, 1882, 1982 during this substage or during prior stages/sub stages.

At substage 2044, the user may engage strap locks 160. In embodiments comprising a D-ring strap lock 160, this stage may be accomplished by snapping down one or more rings 361, similar to as depicted in FIGS. 4A-B. In embodiments comprising an internal clamping strap lock 160, this stage may be accomplished by engaging an element such as a button or lever to apply a clamping force to strap 130; conversely, in some embodiments this stage may be accomplished by disengaging an element such as a button or lever (e.g. where the default state is locked, and an element must be engaged to release). Some embodiments may comprise both D-ring and internal clamping strap locks 160, or other varieties.

At stage 2050, the user may use handle 120 to move load 110, as by lifting, hoisting, dragging, and so forth. One or multiple people and/or machines may be utilized in accomplishing stage 2050, which may comprise utilization of one or a plurality of handles 120, alone or in conjunction with other couplers 140 or accessories 180 such as additional straps 130, hooks, carabiners, bungee cords, clamps, and so forth.

The order of stages presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the invention being indicated by the following claims.

IV. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A modular carrier device comprising:
a plurality of straps;
a securing mechanism for each of the plurality of straps; and
a handle comprising:
at least two strap tunnels, each comprising:
a tunnel cavity;
a tunnel face disposed at each end of the tunnel cavity; and
a locking mechanism configured to substantially prevent traversal of a strap through the tunnel cavity;
wherein the at least two strap tunnels comprise at least one tunnel on opposing ends of the handle, and
further wherein at least one tunnel face is angled progressively inward in the direction toward the bottom of the handle.

2. The modular carrier device of claim 1, wherein the locking mechanism comprises at least one of:
a ring lock disposed on a tunnel face, and
a spring lock disposed in the interior of the strap tunnel.

3. The modular carrier device of claim 1, wherein each of the plurality of straps substantially comprises at least one of nylon, polyester, hemp, cotton, jute, and rubber.

4. The modular carrier device of claim 1, wherein the securing mechanism comprises at least one of a side release clip buckle, a top release clip buckle, a multi-way clip buckle, a ratchet strap, a ratchet and toothed-track buckle, a magnetic buckle, a clamp buckle, a cam lock buckle, a multi-ring buckle, a ladder lock buckle, a tension lock buckle, a quick-attach buckle, a carabiner, and a spring release mechanism.

5. The modular carrier device of claim 1, further comprising a stabilizing system.

6. The modular carrier device of claim 1, further comprising an accessory comprising at least one of a guard, a pad, a cushion, a mount, a hook, a ring, a snap, a buckle, a hook and loop system, a suction cup, a magnet, an elastic cord, a chain, a tie down strap, a netting element, a tarpaulin, a threaded fastener, a cinch, a clamp, a cable tie, an adhesive, a toothed-edge component, a tray, a base, a plate, a bracket, a trough, a wheel, a friction-reducing surface, a friction-enhancing surface, a measurement device, a retractor, a screen, and a communications component.

7. A modular carrier system comprising:
a plurality of straps; and
a handle assembly comprising:
a grip;
at least two strap tunnels, each strap tunnel comprising at least two tunnel openings, wherein each of the at least two strap tunnels and each of that strap tunnel's tunnel openings are dimensioned not substantially larger than sufficient to permit through-travel of at least one of the plurality of straps through that strap tunnel;
a tunnel face disposed at each of the at least two tunnel openings of each of the at least two strap tunnels; and
at least one strap lock disposed upon each of the tunnel faces.

8. The modular carrier system of claim 7:
further wherein the at least two strap tunnels comprises exactly two strap tunnels,
further wherein the at least two tunnel openings of the exactly two strap tunnels comprises exactly two tunnel openings, and
further wherein the at least one strap lock comprises at least one of:
a ring lock disposed on a tunnel face, and
a spring lock disposed in the interior of the strap tunnel.

9. The modular carrier system of claim 7,
further wherein each of the plurality of straps substantially comprises at least one of nylon, polyester, hemp, cotton, jute, and rubber, and
further wherein the handle assembly comprises at least one of polycarbonate and polystyrene.

10. The modular carrier system of claim 7, further comprising at least one load protective component.

11. The modular carrier system of claim 7, wherein the plurality of straps comprises three straps, and the at least two strap tunnels comprises three strap tunnels.

12. The modular carrier system of claim 7, further comprising a stabilizing system.

13. The modular carrier system of claim 7, wherein the grip comprises at least one of fingerhold features and grip features.

14. The modular carrier system of claim 7, wherein the at least one strap lock comprises a D-ring, a hinge, and a lock notch.

15. The modular carrier system of claim 7, further comprising an accessory comprising at least one of a guard, a pad, a cushion, a mount, a hook, a ring, a snap, a buckle, a hook and loop system, a suction cup, a magnet, an elastic cord, a chain, a tie down strap, a netting element, a tarpaulin, a threaded fastener, a cinch, a clamp, a cable tie, an adhesive, a toothed-edge component, a tray, a base, a plate, a bracket, a trough, a wheel, a friction-reducing surface, a friction-enhancing surface, a measurement device, a retractor, a screen, and a communications component.

16. A method for moving a load using a modular carrier system, the modular carrier system comprising:
a plurality of straps, and
a handle assembly comprising:
a grip,
at least two strap tunnels, each strap tunnel comprising at least two tunnel openings, wherein each of the at least two strap tunnels and each of that strap tunnel's tunnel openings are dimensioned not substantially larger than sufficient to permit through-travel of at least one of the plurality of straps through that strap tunnel,
a tunnel face disposed at each of the at least two tunnel openings of each of the at least two strap tunnels, and
at least one strap lock disposed upon each of the tunnel faces,
the method comprising:
securing the modular carrier system to a load, the securing comprising:
threading one of the plurality of straps through each of the at least two strap tunnels, a strap so threaded being a threaded strap;
securing each threaded strap with respect to the load; and
fixing the handle assembly in place with respect to each threaded strap; and
using the handle assembly to move the load.

17. The method of claim 16, wherein the threading one of the plurality of straps through each of the at least two strap tunnels further comprises:
threading each threaded strap through a stabilizer tunnel of a stabilizer component; and
threading an additional strap through a stabilizer channel of the stabilizer component.

18. The method of claim 16, further comprising attaching an accessory to at least one of the plurality of straps, the accessory comprising at least one of a guard, a pad, a cushion, a mount, a hook, a ring, a snap, a buckle, a hook and loop system, a suction cup, a magnet, an elastic cord, a chain, a tie down strap, a netting element, a tarpaulin, a threaded fastener, a cinch, a clamp, a cable tie, an adhesive, a toothed-edge component, a tray, a base, a plate, a bracket, a trough, a wheel, a friction-reducing surface, a friction-enhancing surface, a measurement device, a retractor, a screen, and a communications component.

19. The method of claim 18, wherein the accessory comprises at least one trough, further wherein the load is substantially planar, further wherein the load is positioned in the trough, further wherein the handle assembly is used to lift the load.

20. The method of claim 16, further comprising securing an additional modular carrier system to the load, wherein the using the handle assembly to move the load further comprises using the handle assembly of the additional modular carrier system to move the load.

* * * * *